US005250996A

United States Patent [19]

Sugizaki et al.

[11] Patent Number: 5,250,996

[45] Date of Patent: * Oct. 5, 1993

[54] METHOD FOR FIXING FULL COLOR TONER IMAGES

[75] Inventors: Yutaka Sugizaki; Hiroshi Takayama; Hideyuki Akagi; Takashi Imai; Susumu Saito; Yoshio Shoji; Yasuhiro Uehara; Masanori Ichimura; Tomohiro Ohkawa; Manabu Serizawa; Yasuo Yamamoto; Michio Take; Satoshi Inoue, all of Kanagawa, Japan

[73] Assignee: Fuji Xerox Co., Ltd., Tokyo, Japan

[ * ] Notice: The portion of the term of this patent subsequent to Oct. 20, 2009 has been disclaimed.

[21] Appl. No.: 882,136

[22] Filed: May 13, 1992

Related U.S. Application Data

[63] Continuation-in-part of Ser. No. 683,806, Apr. 11, 1991, Pat. No. 5,157,445.

[30] Foreign Application Priority Data

Apr. 12, 1990 [JP] Japan ..... 2-94976
May 14, 1991 [JP] Japan ..... 3-137045

[51] Int. Cl.[5] ..... G03G 15/20

[52] U.S. Cl. ..... 355/284; 355/282; 355/295; 430/109; 430/124

[58] Field of Search ..... 355/282, 284, 285, 289, 355/290, 295, 326, 327; 430/109, 137, 124; 524/188, 272

[56] References Cited

U.S. PATENT DOCUMENTS 4,549,803 10/1985 Ohno et al. ..... 355/284
4,565,762 1/1986 Kato ..... 355/284 X
4,588,668 5/1986 Yasuda et al. ..... 430/109
4,722,951 2/1988 Yoshioka et al. ..... 524/188 X
4,863,824 9/1989 Uchida et al. ..... 430/109
4,939,059 7/1990 Kawabe et al. ..... 430/109 X

*Primary Examiner*—A. T. Grimley
*Assistant Examiner*—Sandra L. Brasé
*Attorney, Agent, or Firm*—Finnegan, Henderson, Farabow, Garrett & Dunner

[57] ABSTRACT

A method for fixing a full color toner image by inserting a transfer medium to which a toner image is transferred, between a pair of rolls of a fixing apparatus, and pressing the medium therebetween, wherein the toner image is formed of a full color toner prepared by dispersing a colorant into a polyester resin containing a diol component represented by the following general formula (I) as a constituent and having a softening point of 100° to 120° C., as measured by a ring and ball method, a glass transition temperature of 55° C. or more, a Gardner color scale of 2 or less and a haze value of 15 or less, and the fixing operation is conducted while supplying a functional group-containing organopolysiloxane having a viscosity of 10 to 100,000 cs at 25° C. to a roll in contact with the toner image, whereby the full color toner image can be stably fixed without wrapping of the transfer medium around the roll and offset, and the fixed image having good image quality can be obtained:

(I)

wherein R represents an ethylene group or a propylene group, each of x and y is an integer of 1 or more, and x+y is 2 to 6.

2 Claims, 1 Drawing Sheet

METHOD FOR FIXING FULL COLOR TONER IMAGES

This application is a continuation-in-part of U.S. patent application Ser. No. 07/683,806, filed Apr. 11, 1991 in the names of Yoshio Shoji, Yasuhiro Uehara, and Yasuji Fukase, now U.S. Pat. No. 5,157,445.

FIELD OF THE INVENTION

The present invention relates to a method for fixing color toner images transferred to a transfer medium.

BACKGROUND OF THE INVENTION

When images are formed by full color copying machines, color reproduction is carried out by the use of cyan, magenta, yellow and black toners. The respective toners are superimposed and melted by heating to obtain secondary colors and further tertiary colors. At that time, for example, when a secondary color is obtained by superimposing two kinds of toners, the color difference from the secondary color actually obtained is determined according to the transparency of a toner layer.

Namely, the color toners are required to have the fixing characteristics that they are transparent to such a degree that the color tone of a toner layer arranged thereunder and different therefrom in color tone is not disturbed and that they are rapidly melted on heating to prevent diffused reflection of light at the surface of the fixed image. In order to obtain these characteristics, full color toners containing polyester resins and specified colorants are disclosed in JP-A-50-62442 (the term "JP-A" as used herein means an "unexamined published Japanese patent application), JP-A-50-63939 and JP-A-51-24234. In this case, however, the problem arises that the fixed image is offset to fixing rolls. In order to solve this problem, it has been attempted to use a trivalent or more valent acid or alcohol as a monomer for a polyester to control the viscoelasticity, thereby preventing the offset. However, if the elastic term of the viscoelasticity is increased too much, the sharp melting property (the term "sharp melting property" as used herein means that toner is melted instantly) is damaged, and the color developing property and the light permeability of an OHP sheet are deteriorated, which results in unfitness for practical applications. It is therefore difficult to allow the offset property and the transparency of the OHP sheet to be compatible with each other.

Further, JP-A-2-293867 discloses an attempt to solve the offset problem by a combination of a sharp melting polyester and a fixing apparatus. Also in this method, silicone oil for imparting mold release property is required to be supplied in excess for the purpose of preventing the offset to fixing rolls. A large amount of oil is therefore transferred to a fixing medium (paper or an OHP sheet) after fixing. When the fixing medium is paper, the transferred oil makes it difficult to write on the fixing paper in pencil or ball pen. In the case of the OHP sheet, the problem remains that the light permeability is deteriorated.

In addition to this, when a colorant is insufficiently dispersed in a full color toner, the color reproducibility and the light permeability of the OHP sheet are deteriorated. As methods for improving this disadvantage, the use of dyes or dye-pigment mixtures as colorants has been proposed. When the dyes are used, the color reproducibility and the light permeability of the OHP sheet are improved. However, the problem arises that the color tone of full color fixed images varies with time because of inferior weather resistance of the dyes themselves. Moreover, when a polyvinyl chloride sheet containing a plasticizer is brought into contact with a fixed image, the dye is transferred to the polyvinyl chloride sheet to bring about contamination of the polyvinyl chloride sheet.

In addition, when a polyester resin is used as the polymer for toners, the fixed image characteristics required for the full color toners are sufficient. When used in combination with a carrier, however, the polyester resin has the problem that the temperature-humidity dependence of electrostatic charge is increased which is considered to result from a carboxyl group or a hydroxyl group at the terminus of its molecule or an ester linkage at an intermediate portion of the molecule. Accordingly, the problem of excess charge amount under low humidity and of deficient charge amount under high humidity is encountered, and it is difficult to provide a color toner having the frictional charge amount stable under a wide range of environmental conditions.

SUMMARY OF THE INVENTION

It is therefore an object of the present invention to provide a method for fixing color toner images which can overcome the disadvantages of the sharp melting polyesters most suitable for attaining a high color development, a high gloss and a good OHP light permeability required for full color toners, namely wrapping of paper around the fixing rolls and occurrence of the offset of the fixed images which result from that the toner is highly sticky on melting.

Another object of the present invention is to provide a method for fixing color toner images which can solve the problems introduced by supplying oily anti-offset agents in large amounts, namely the problems that writing on the fixed images in pencil or ball pen becomes impossible, that the light permeability of the OHP sheet is decreased, and that the evaporated anti-offset agents are scattered and lost out of the copying machine.

A further object of the present invention is to provide a method for fixing color toner images which can solve the problems of a decrease in color developing property and a reduction in the light permeability of the OHP sheet caused by poor dispersion of the pigments in the toners.

According to the present invention, there is provided a method for fixing a full color toner image by inserting a transfer medium to which a toner image is transferred, between a pair of rolls of a fixing apparatus, and pressing the medium therebetween, wherein said toner image is formed of a full color toner prepared by dispersing a colorant into a polyester resin containing a diol component represented by the following general formula (I) as a constituent and having a softening point of 100° to 120° C., as measured by a ring and ball method, a glass transition temperature of 55° C. or more, a Gardner color scale of 2 or less and a haze value of 15 or less, and the fixing operation is conducted while supplying a silicone composition containing at least a functional group-containing organopolysiloxane having a viscosity of 10 to 100,000 cs at 25° C. represented by the following general formula (II) to a roll in contact with the toner image:

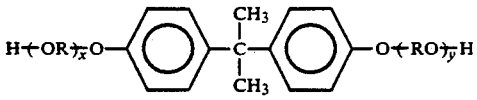

(I)

wherein R represents an ethylene group or a propylene group, each of x and y is an integer of 1 or more, and x+y is 2 to 6,

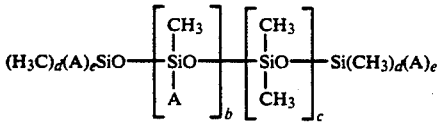

(II)

wherein A represents $-R^1NH_2$, $-R^1NHR^2NH_2$, $-R^1-O-Y_f-H$ or $-H$ (wherein each of $R^1$ and $R^2$ represents an alkylene group having 1 to 8 carbon atoms and Y represents an alkyleneoxy group having 2 to carbon atoms), b is 0 to 10, c is 10 to 1,000, d is 2 or 3, e is 0 or 1, f is 0 to 10, d+e is 3, and b and c are not 0 at the same time.

DETAILED DESCRIPTION OF THE INVENTION

Figure 1:
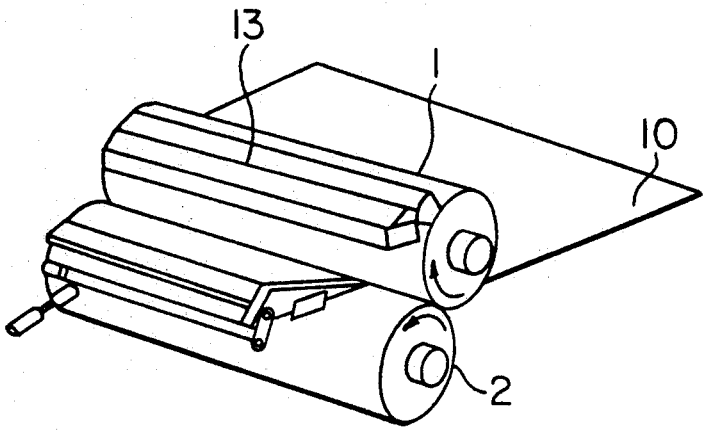
FIG. 1 is a perspective view showing an embodiment of a fixing apparatus used in the present invention.

The present invention will hereinafter be described in detail.

The toner used for forming full color toner images in the present invention comprises a polyester and a colorant dispersed therein. The polyester resin used in the present invention contains the bisphenol derivative represented by the above-described general formula (I) as an essential diol constituent. The diol component represented by general formula (I) can be used in combination with ethylene glycol, propylene glycol, 1,3-butanediol, 1,4-butanediol, 2,3-butanediol, diethylene glycol, 1,5-pentanediol, 1,6-hexanediol, neopentyl glycol, hydrogenated bisphenol A, cyclohexanedimethanol, etc.

Further, acid components which can be used herein include dicarboxylic acids such as terephthalic acid, isophthalic acid, fumaric acid, succinic acid, adipic acid and sebacic acid; and tricarboxylic acids such as trimellitic acid, pyromellitic acid and anhydrides thereof.

The polyesters composed of these diol components and acid components are required to have a softening point of 100° to 120° C., preferably 105° to 115° C., as measured by the ring and ball method. If the softening point is higher than 120° C., the minimum fixing temperature becomes too high, and therefore the fixing roll temperature must be elevated. In the meantime, if the softening point is lower than 100° C., toner blocking is liable to occur. The glass transition temperature (Tg) of less than 55° C. results in occurrence of toner blocking and insufficient storage stability.

The measurement of the softening point of the polyesters by the ring and ball method is conducted in accordance with the method described in Japanese Industrial Standards (JIS) K2207 (Testing Method of Petroleum Asphalt) 5. 4. As a tester for evaluating this characteristic, a ring and ball type automatic softening point measuring apparatus produced by Meihousha Seisakusho can be used.

The polyester resins are required to have a Gardner color scale of 2 or less. The polyester resins are little colored by reducing the Gardner color scale to 2 or less, so that impact on reproduction of light colors such as yellow can be decreased.

The measurement of the Gardner color scale can be carried out by the method described in JIS K5400 (General Testing Method of Coating) 4. 1. 2. According to this method, the color of a sample prepared on the basis of a specified method is indicated by a color number of a color glass equivalent to the Gardner color scale standard solution. Namely, the sample is placed in a Gardner color scale tube (a colorless transparent glass tube having an inner diameter of 10 mm and a depth of 110 mm), and this color scale tube is heated to 160° C. to melt the resin completely to a transparent liquid, followed by deaeration. The melted sample is set in a Gardner-Hellige colorimeter, and a colorimetric plate is rotated to compare the color of the sample with that of the plate by the use of transmitted light. When both agree with each other, a humeral which appears on a window is read.

Furthermore, the polyester resins are required to have a haze value of 15 or less. The haze value is important as a quantitative measure showing the transparency of the polyester resins. The transparency of the polyester resins can be improved by decreasing the haze value to 15 or less, and impact on the color reproducibility and the light permeability of the OHP sheet can be reduced.

The haze value can be measured using a hazemeter as described in ASTM. Test pieces are prepared so that no scratch is formed on the surface thereof and no bubble inside, and measurement was conducted using a pivotable-sphere hazemeter.

In the present invention, any known pigment may be used as the colorant. Typical examples of the pigments which can be used include organic pigments such as C.I. Pigment Red 57:1, 64:1, 81, 83, 114, 112, 122, 146, 170, and 185; C.I. Pigment Blue 15:3, 17:1, 1, 15 and 2; and C.I. Pigment Yellow 12, 13, 17, 97, 1, 3, 55, 74, 81, 83 and 120. In addition, other organic pigments used in printing ink can also be used.

It is particularly preferred that these organic pigments are subjected to flashing treatment. Dispersed units of the organic pigments can be finely divided (0.3 μm or less) and uniformly dispersed by the flashing treatment, whereby a decrease in light permeability due to coarse dispersed particles of the organic pigments can be minimized, and the light permeability of the OHP sheet and the color reproducibility can be improved.

In the present invention, black pigments such as carbon black can also be used as the pigments. Carbon black having an average primary particle diameter of 35 to 80 mμm, preferably 40 to 75 mμm, can be used. Carbon black is added usually in an amount of 2.0 to 10% by weight, and preferably in an amount of 2.0 to 6.0% by weight.

The toner particles used for formation of full color particle diameter of 5 to 9 μm. It is preferred to add additives to the toner particles.

As the additive, amorphous titania, an inorganic spherical fine powder (e.g., silica, alumina, titanium oxide, or those subjected to hydrophobic treatment) or an organic spherical fine powder (e.g., fine particles of polymer such as polymethyl methacrylate) is used. Amorphous titania acts as an agent for improving fluidity, and the electrostatic property of the polyester resins can be improved by treating its surface with a coupling agent to render it hydrophobic. Further, the inorganic or organic spherical fine powder shows development-transferring property and cleaning improving effect.

In particular, amorphous titania having a particle diameter of 10 to 20 nm rendered hydrophobic and the inorganic or organic spherical fine powder having a particle diameter of 20 to 80 nm are preferably used.

As the coupling agents used for rendering amorphous titania hydrophobic, coupling agents which efficiently react with hydroxyl groups on the surface of fine amorphous titania particles are preferably used. The coupling agents preferable for enhancing the bonding property to the surface include, for example, $CH_3Si(NCO)_3$, $C_{10}H_{21}Si(OCH_3)_3$ and $CF_3Si(OCH_3)_3$.

The fine amorphous titania particles to be treated have the characteristics that the hydroxyl group value on the surface is high and the reactivity with the coupling agents is high, and can give a high chargeability to the toner particles and improve the temperature-humidity dependency, as compared to rutile or anatase structure crystalline titanium oxide. The fine amorphous particles used herein have a primary particle diameter of 1.0 μm or less, preferably 0.3 μm or less.

These additive are added to the toner particles in an amount of 0.5 to 3% by weight, preferably 0.5 to 2% by weight, for amorphous titania, and in an amount of 0.3 to 3% by weight, preferably 0.5 to 2% by weight, for the inorganic or organic fine powder.

In the present invention, the transfer medium carrying toner images formed of the above-described full color toner particles is inserted between a pair of rolls of the fixing apparatus, and pressing the medium therebetween to perform fixing. In this case, it is necessary to conduct the fixing operation while supplying the silicone composition containing at least the functional group-containing organopolysiloxane having a viscosity of 10 to 100,000 cs at 25° C. represented by the above-described general formula (II) to at least the roll in contact with the toner images of the rolls of the fixing apparatus.

Examples of the functional group-containing organopolysiloxanes represented by the above-described general formula (II) include compounds represented by the following general formula (III):

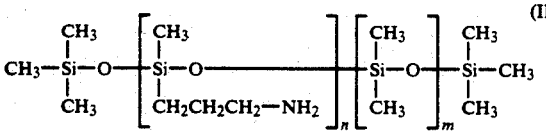

(III)

wherein m is 10 to 1,000 and n is 0 to 1.

For the above-described silicone composition, an organopolysiloxane having a viscosity of 10 to 100,000 cs at 25° C. represented by the following general formula (IV) may be added to the silicone composition represented by general formula (II) in an amount of 0 to 10,000 parts by weight based on 100 parts by weight of the silicone composition represented by general formula (II).

$$R_{3a}SiO_z \quad \text{(IV)}$$

wherein $R_3$ represents an alkyl or aryl group having 1 to 8 carbon atoms, $1.95<a<2.20$ and $z=(4-a)/2$.

In the present invention, since the above-described functional group-containing organopolysiloxanes have the high ability to impart mold release property, the offset to the fixing rolls and the wrapping of paper around them can be prevented by supply of small amounts of silicone compositions containing the organopolysiloxanes, and the transfer of the mold release agents (i.e., silicone compositions) to the fixing media (paper or OHP sheets) can be minimized. It becomes therefore possible to write on the fixed images in pencil or ball pen. For the OHP sheets, micro unevenness which irregularly reflects light is hard to occur on the surfaces of the fixed images because of high mold release property of the fixing rolls, and the fixed images having a flat surface structure can be formed, thereby improving the light permeability.

In the present invention, the fixing is preferably conducted by heat and pressure, using the fixing apparatus comprising a pair of rolls, for example, which are provided with heating sources therein.

The fixing apparatus used in the present invention is illustrated by reference to the drawings. FIG. 1 is a perspective view showing an embodiment of the fixing apparatus, FIG. 2 is a cross sectional view thereof and FIG. 3 is a schematic view showing a deformed state of a roll during fixing.

Figure 2:
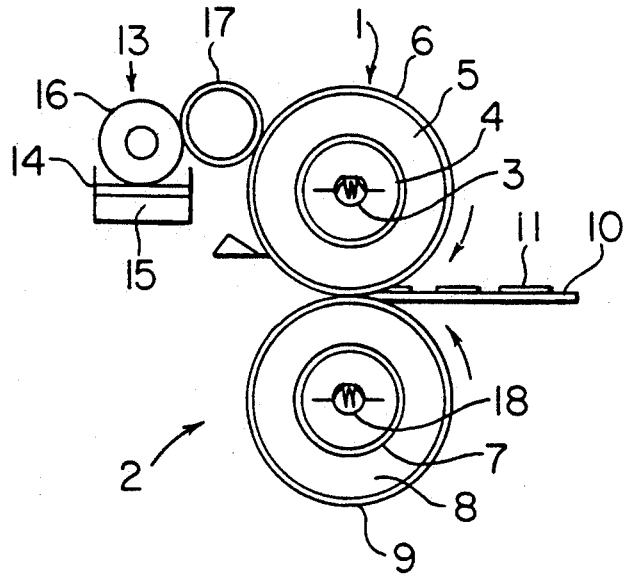
FIG. 2 is a cross sectional view showing the embodiment shown in FIG. 1.
Figure 3:
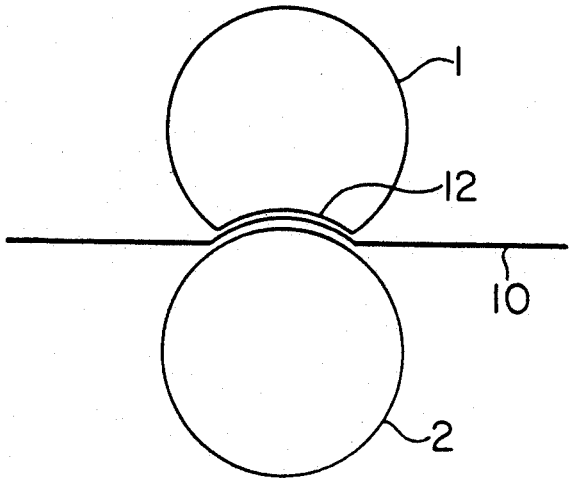
FIG. 3 is a schematic view showing a deformed state of a roll during fixing.

As shown in FIG. 2, the fixing apparatus comprises a main part made up of a heating roll 1 and a pressure roll 2. The heating roll 1 comprises a substrate roll 4 provided with a heating source 3 therein, and an inner elastic layer 5 and an outer elastic layer 6 formed on the substrate roll 4. The pressure roll 2 comprises a substrate roll 7 provided with a heating source 18 therein, and an inner elastic layer 8 and an outer elastic layer 9 formed on the substrate roll 7. A means for supplying a mold release agent 13 is mounted on one side of the heating roll 1. Namely, a silicone composition 14, the mold release agent, contained in an oil pan is supplied on a coating roll 17 mounted in contact with the heating roll 1 through a feed roll 16. The reference numeral 10 designates transfer paper, and the reference numeral 11 designates a toner image.

In this fixing apparatus, the inner elastic layer 5 of the heating roll 1 and the inner elastic layer 8 of the pressure roll 2 are formed of synthetic rubber having the same hardness. However, the inner elastic layer 5 of the heating roll 1 is formed thinner than the inner elastic layer 8 of the pressure roll 2. When the heating roll 1 and the pressure roll 2 are pressed to each other, therefore, the inner elastic layer 5 of the heating roll 1 is pressed by the pressure roll 2 to be deformed to a concave form, and a concave portion 12 is formed at a contact portion of the inner elastic layer 5 of the heating roll 1, as shown in FIG. 3. When the concave portion 12 is thus formed on the heating roll 1, the transfer paper 10 is deformed to the same form as the concave portion 12 of the heating roll 1, as the transfer paper 10 passes through a nip portion of the heating roll 1 and the pressure roll 2. For this reason, the peripheral speed of the heating roll 1 deformed to the concave form is slower than the pressure roll 2 not deformed by the longer peripheral length of the heating roll 1. Accordingly, when the transfer paper 10 passes through the nip portion of the heating roll 1 and the pressure roll 2, so-called "squeezing" force is applied to the transfer paper 10 so that the surface side of the transfer paper 10 is separated from the heating roll 1. The transfer paper 10 can therefore be separated from the heating roll 1 much more without wrapping of the transfer paper 10 around the heating roll 1, as well as offset preventing effect of the above-described silicone compositions. Hence, in the fixing apparatus for fixing color toners liable to be offset and used in large amounts, the transfer paper 10 can be effectively prevented from wrapping around the heating roll 1.

With respect to means for supplying the above-described silicone composition to the surface of the fixing roll, the silicone composition 14 contained in the oil pan 15 is supplied through the coating roll 17 in contact with the surface of the fixing roll, as shown in FIG. 2. However, the supplying method is not limited thereto, but the method of bringing a web impregnated with the silicone composition into contact with the surface of the fixing roll may also be employed.

PREPARATION EXAMPLE A

Preparation of Cyan Flashing Pigment a

Hydrous paste of copper phthalocyanine (C.I. Pigment Blue-15:3) obtained in pigmentation stage: 42.9 parts by weight Polyester resin (synthesized from a bisphenol A-ethylene oxide adduct, cyclohexanedimethanol and terephthalic acid; softening point as measured by the ring and ball method: 105° C.; Tg: 60° C.; Gardner color scale: 1; Haze value: 8): 100 parts by weight The above-described components were kneaded in a kneader heated at 150° C. to substitute water contained in the hydrous pigment paste by the melted polyester resin, thereby obtaining a resin dispersion type cyan pigment composition having a pigment content of 30% by weight. The resin dispersion type cyan pigment particles had a particle diameter ranging from 0.05 to 0.25 μm and were uniformly dispersed. This pigment composition is named cyan flashing pigment a.

PREPARATION EXAMPLE B

Preparation of Magenta Flashing Pigment b

Magenta flashing pigment b was obtained in the same manner as with Preparation Example A with the exception that a hydrous paste of Carmine 6BC (C.I. Pigment Red 57:1) was substituted for the hydrous paste of copper phthalocyanine. The dispersed particle diameter of the resulting flashing pigment particles was in the range of 0.02 to 0.1 μm.

PREPARATION EXAMPLE C

Preparation of Yellow Flashing Pigment c

Yellow flashing pigment c was obtained in the same manner as with Preparation Example A with the exception that a hydrous paste of monoazo yellow (C.I. Pigment Yellow 97) was substituted for the hydrous paste of copper phthalocyanine. The dispersed particle diameter of the resulting flashing pigment particles was in the range of 0.2 to 0.3 μm.

PREPARATION EXAMPLE 1

Preparation of Toner Composition A

Polyester resin (synthesized from a bisphenol A-ethylene oxide adduct, cyclohexanedimethanol and terephthalic acid; softening point as measured by the ring and ball method: 104° C.; Tg: 60° C.; Gardner color scale: 1; Haze value: 9): 100 parts by weight Cyan flashing pigment a: 16 parts by weight The above-described components were mixed with each other, and the mixture was melted and kneaded by an extruder, followed by rough grinding in a hammer mill after cooling. The particles were ground to a diameter of 7 μm by the use of an air jet type fine grinding machine, and the resulting particles were classified to obtain toner particles. To 100 parts by weight of the resulting toner particles, 1.0 part by weight of 15 μm-sized amorphous titania (trade name: UFP, produced by Idemitsu Kosan) treated with $CH_3Si(NCO)_3$ for rendering hydrophobic and 0.8 part by weight of silica (trade name: OX50, produced by Nippon Aerosil) having an average particle diameter of 40 μm treated for rendering hydrophobic were added, followed by mixing by means of a high-speed mixer to obtain toner composition A.

PREPARATION EXAMPLE 2

Preparation of Toner Composition B

Polyester resin (synthesized from a bisphenol A-ethylene oxide adduct, cyclohexanedimethanol and terephthalic acid; softening point as measured by the ring and ball method: 108° C.; Tg: 62° C.; Gardner color scale: 2; Haze value: 7): 100 parts by weight Cyan flashing pigment a: 16 parts by weight Toner composition B was prepared in the same manner as with Preparation Example 1 with the exception that the above-described components were used.

PREPARATION EXAMPLE 3

Preparation of Toner Composition C

Polyester resin (synthesized from a bisphenol A-ethylene oxide adduct, cyclohexanedimethanol and terephthalic acid; softening point as measured by the ring and ball method: 113° C.; Tg: 65° C.; Gardner color scale: 1; Haze value: 7): 100 parts by weight Cyan flashing pigment a: 16 parts by weight Toner composition C was prepared in the same manner as with Preparation Example 1 with the exception that the above-described components were used.

PREPARATION EXAMPLE 4

Preparation of Toner Composition D

Toner composition D was prepared in the same manner as with Preparation Example 2 with the exception that magenta flashing pigment b was substituted for cyan flashing pigment a.

PREPARATION EXAMPLE 5

Preparation of Toner Composition E

Toner composition E was prepared in the same manner as with Preparation Example 2 with the exception that yellow flashing pigment c was substituted for cyan flashing pigment a.

PREPARATION EXAMPLE 6

Preparation of Toner Composition F

Polyester resin (synthesized from a bisphenol A-ethylene oxide adduct, cyclohexanedimethanol and terephthalic acid; softening point as measured by the ring and ball method: 130° C.; Tg: 67° C.; Gardner color scale: 2; Haze value: 7) 100 parts by weight Cyan flashing pigment a: 16 parts by weight Toner composition F was prepared in the same manner as with Preparation Example 1 with the exception that the above-described components were used.

PREPARATION EXAMPLE 7

Preparation of Toner Composition G

Toner composition G was prepared n the same manner as with Preparation Example 2 with the exception that an untreated copper phthalocyanine (C.I. Pigment Blue 15:3) pigment was used as it is in place of cyan flashing pigment a.

EXAMPLE 1

Using toner compositions A and B, and ferrite particles having a particle diameter of about 50 μm coated with 0.5% by weight of a styrene-methyl methacrylate copolymer as a carrier, developers were prepared to a toner concentration of 8% by weight. Using these developers and an additional toner composition, the monocolor mode copying test was carried out by the use of a full color copying machine (modified "6800", produced by Fuji Xerox). The fixing apparatus shown in FIGS. 1 and 2 was used.

The above-described heating roll 1 was provided with a 500 W quartz lamp 3 therein, and comprised a substrate roll 4 having an outer diameter of 44 mm formed of a steel type core material, an inner elastic layer 5 having a rubber hardness of 60°, as expressed by the JIS hardness, and a thickness t of 3 mm which is formed on the substrate roll 4 through an appropriate primer and composed of a mixture of 100 parts by weight of crystalline silica, 0.8 part by weight of a curing agent (RC-4, produced by Toray Industries) and 100 parts by weight of a silicone compound (SH841U, produced by Toray Industries), and an outer elastic layer 6 having a thickness t of 40 mm which is formed on the inner elastic layer 5 and composed of a mixture of 2 parts by weight of carbon (Thermal Black MT, produced by Cabot), 10 parts by weight of magnesium oxide (#30, produced by Kyowa Kagaku) and 100 parts by weight of fluoroelastomer (for example, Viton Rubber (trade name): B-50, produced by Du Pont).

On the other hand, the pressure roll 2 was provided with a 500 W quartz lamp therein, and comprised a substrate roll 7 having an outer diameter of 48 mm formed of a steel type core material, an inner elastic layer 8 having a rubber hardness of 60°, as expressed by the JIS hardness, and a thickness t of 1 mm formed on the substrate roll 7 through an appropriate primer and composed of a mixture of 50 parts by weight of crystalline silica and 0.8 part by weight of a curing agent (RC-4, produced by Toray Industries) with 100 parts by weight of a silicone compound (SH841U, produced by Toray Industries), and an outer elastic layer 9 having a thickness t of 40 mm formed on the inner elastic layer 8 and composed of a mixture of 2 parts by weight of carbon (Thermal Black MT, produced by Cabot) and 10 parts by weight of magnesium oxide (#30, produced by Kyowa Kagaku) with 100 parts by weight of fluoroelastomer (for example, Viton Rubber (trade name): B-50, produced by Du Pont).

The above-described heating roll 1 and pressure roll 2 were pressed to each other by a pressing mechanism not shown in the drawings to form a nip portion having a width of 6 mm at an intermediate portion. Further, the heating roll 1 and the pressure roll 2 were driven for rotation at a surface velocity of 150 mm/second in the directions of the arrows, respectively.

The surface temperature of the pressure roll was fixed to 150° C. and the surface temperature of the heating roll was varied from 120° C. to 240° C., while supplying an amine-modified silicone oil having a viscosity of 300 cs at 25° C. represented by general formula (III) wherein m is 130 and n is 0.1. The minimum color development temperature, the minimum fixing temperature and the offset generation temperature were evaluated using toner compositions A and B.

The paper separation test was carried out by fixing the surface temperature of the pressure roll to 150° C. and changing the surface temperature of the heating roll from 120° C. to 180° C.

When the OHP sheet was fixed, the transparency was evaluated by setting the surface temperature of the pressure roll to 150° C., the surface temperature of the heating roll to 160° C. and the surface velocity of the heating roll to 50 mm/second. Results thus obtained are shown in Table 1.

EXAMPLE 2

Using toner compositions C, D and E, developers were prepared in the same manner as with Example 1, and the copying test was carried out by the use of a copying machine (modified "6800", produced by Fuji Xerox) changed to the full color mode. As a result, the trouble of images due to poor developing property of the toners or poor transfer property was not produced, and the problem of poor cleaning of the photoreceptor was not also encountered, even after 30,000 copies. Moreover, the offset of the toners to the heating roll and the wrapping of paper around the heating roll did not take place, and fine full color images could be obtained. Results thereof are also shown in Table 1.

EXAMPLE 3

The evaluation was conducted in the same manner as with Example 1 with the exception that toner composition G was used. Results thereof are also shown in Table 1.

COMPARATIVE EXAMPLE 1

The evaluation was conducted in the same manner as with Example 1 with the exception that toner composition F was used. Results thereof are also shown in Table 1.

COMPARATIVE EXAMPLE 2

The evaluation was conducted in the same manner as with Example 1 with the exception that a dimethylsilicone oil having a viscosity of 300 cs at 25° C. was substituted for the amine-modified silicone oil and toner composition A was used. Results thereof are also shown in Table 1.

TABLE 1

| Toner | Example 1 | | Example 2 | | | Example 3 | Comparative Example 1 | Comparative Example 2 |
|---|---|---|---|---|---|---|---|---|
| Composition | A | B | C | D | E | G | F | A |
| Silicone Composition | Amine-modified silicone oil | Amine-modified silicone oil | Amine-modified silicone oil | Amine-modified silicone oil | Amine-modified silicone oil | Amine-modified silicone oil | Amine-modified silicone oil | Dimethyl silicone oil |
| Minimum Color Development Temperature | 132° C. | 138° C. | 142° C. | 138° C. | 137° C. | 135° C. | 160° C. | 136° C. |
| High Temperature Offset Generation Temperature | 230° C. or more | 230° C. or more | 240° C. or more | 230° C. or more | 230° C. or more | 230° C. or more | 240° C. or more | 210° C. |
| Minimum Fixing Temperature of Character Image | 130° C. or less | 130° C. or less | 130° C. or less | 130° C. or less | 130° C. or less | 130° C. or less | 130° C. or less | 130° C. or less |
| Paper Separation Property | | | | | | | | |
| (Thin Paper) | Good | Good | Good | Good | Good | Good | Good | Wrapping occurs |
| (Thick Paper) | Good | Good | Good | Good | Good | Good | Good | Good |
| Writing on Fixed Image in Pen | Possible | Possible | Possible | Possible | Possible | Possible | Possible | Becomes thin, impossible |
| OHP Transparency | Good | Good | Good | Good | Good | Somewhat dull images | Transparency/ color mixing decrease due to insufficient melting of the toner | Dull images are produced due to oil transfer |

The minimum color development temperature means a temperature at which the gloss value of a copy measured by a glossmeter [Glossguard II (angles of incidence and reflection: 75°), produced by Gardner, U.S.A.] reaches 40 or more.

The high temperature offset temperature means a temperature at which fixed toner particles are transferred to the roll again.

The minimum fixing temperature of a character image means a temperature at which the rate of a residual character image to an original fixed image is 70% which is evaluated after the fixed image has been squeezed by a squeeze tester under a definite load.

The paper separation property is visually decided by wrapping of paper around the roll. The paper is 65 g/m$^2$ for the thick paper and 56 g/m$^2$ for the thin paper.

PREPARATION EXAMPLE 8

Preparation of Toner Composition H

Polyester resin (synthesized from a bisphenol A-ethylene oxide adduct, cyclohexanedimethanol and terephthalic acid; softening point as measured by the ring and ball method: 102° C.; Tg: 58° C.; Gardner color scale: 2; Haze value: 6): 97 parts by weight Carbon black (REGAL99R, produced by Cabot, primary particle diameter: 36 mμm): 3 parts by weight The above-described components were melted and kneaded by an extruder, followed by rough grinding in a hammer mill after cooling. The roughly ground particles were ground to a diameter of 9 μm by the use of an air jet type fine grinding machine, and the resulting particles were classified to obtain toner particles. To 100 parts by weight of the resulting toner particles, 0.7 part by weight of 15 μm-sized amorphous titania (trade name: UFP, produced by Idemitsu Kosan) treated with $CH_3Si(NCO)_3$ for rendering hydrophobic and 0.6 part by weight of silica (trade name: OX50, produced by Nippon Aerosil) having an average particle diameter of 40 μm treated with hexamethyldisilazane for rendering hydrophobic were added, followed by mixing by means of a high-speed mixer to obtain toner composition H.

PREPARATION EXAMPLE 9

Preparation of Toner Composition I

Polyester resin (synthesized from a bisphenol A-ethylene oxide adduct, cyclohexanedimethanol and terephthalic acid; softening point as measured by the ring and ball method: 105° C.; Tg: 61° C.; Gardner color scale: 2; Haze value: 9): 97 parts by weight Carbon black (#25, produced by Mitsubishi Chemical Industries, average primary particle diameter: 47 mμm): 3 parts by weight Toner composition I was prepared in the same manner as with Preparation Example 8 with the exception that the above-described components were used.

PREPARATION EXAMPLE 10

Preparation of Toner Composition J

Polyester resin (synthesized from a bisphenol A-propylene oxide adduct, fumaric acid and terephthalic acid; softening point as measured by the ring and ball method: 108° C.; Tg: 62° C.; Gardner color scale: 1; Haze value: 8): 96 parts by weight Carbon black (BP160, produced by Cabot, primary particle diameter: 50 mμm): 4 parts by weight Toner composition J was prepared in the same manner as with Preparation Example 8 with the exception that the above-described components were used.

PREPARATION EXAMPLE 11

Preparation of Toner Composition K

Polyester resin (synthesized from a bisphenol A-ethylene oxide adduct, cyclohexanedimethanol and terephthalic acid; softening point as measured by the ring and ball method: 113° C.; Tg: 65° C.; Gardner color scale: 1; Haze value: 7): 97 parts by weight Carbon black (Black Pearls 280, produced by Cabot, primary particle diameter: 41 mμm): 3 parts by weight Toner composition K was prepared in the same manner as with Preparation Example 8 with the exception that the above-described components were used.

PREPARATION EXAMPLE 12

Preparation of Toner Composition L

Polyester resin (synthesized from a bisphenol A-ethylene oxide adduct, cyclohexanedimethanol and terephthalic acid; softening point as measured by the ring and ball method: 130° C.; Tg: 67° C.; Gardner color scale: 2; Haze value: 7): 97 parts by weight Carbon black (Black Pearls 280, produced by Cabot, primary particle diameter: 41 mμm): 3 parts by weight Toner composition L was prepared in the same manner as with Preparation Example 8 with the exception that the above-described components were used.

EXAMPLE 4

Using toner compositions H to K, developers were prepared and the copying test was conducted in the same manner as with Example 1. Results thereof are shown in Table 2.

COMPARATIVE EXAMPLE 3

Using toner composition L, a developer was prepared and the copying test was conducted in the same manner as with Example 1. Results thereof are shown in Table 2.

Although there was no problem for chargeability, the minimum fixing temperature was high. In the continuous copying test, therefore, the heat supply to the heating roll was not enough, which caused fluctuations in gloss of full color images.

COMPARATIVE EXAMPLE 4

The copying test was conducted in the same manner as with Example 1 with the exception that a dimethylsilicone oil having a viscosity of 300 cs at 25° C. was used as the mold release agent supplied to the heating roll. Results thereof are shown in Table 2.

A larger amount of oil was required to be supplied, compared to the amine-modified silicone oil. It was therefore impossible to write on the fixed image paper in pen.

TABLE 2

| Toner | Example 4 | | | | Comparative Example 3 | Comparative Example 4 |
|---|---|---|---|---|---|---|
| Composition | H | I | J | K | L | I |
| Silicone Composition | Amine-modified silicone oil | Amine-modified silicone oil | Amine-modified silicone oil | Amine-modified silicone oil | Amine-modified silicone oil | Dimethyl silicone oil |
| Minimum Color Development Temperature | 128° C. | 132° C. | 138° C. | 142° C. | 160° C. | 133° C. |
| High Temperature Offset Generation Temperature | 230° C. | 230° C. or more | 230° C. or more | 240° C. or more | 240° C. or more | 210° C. |
| Minimum Fixing Temperature of Character Image | 125° C. | 130° C. or less | 130° C. or less | 130° C. or less | 130° C. or less | 130° C. or less |
| Paper Separation Property | | | | | | |
| (Thin Paper) | Good | Good | Good | Good | Good | Wrapping occurs |
| (Thick Paper) | Good | Good | Good | Good | Good | Wrapping occurs |
| Writing on Fixed Image in Pen | Possible | Possible | Possible | Possible | Possible | Becomes thin, impossible |

According to the present invention, the problems which arise when the conventional full color toners are used are solved, and the wrapping of paper around the fixing roll and the offset of the fixed images do not take place. Further, the fixed images can be obtained on which it is possible to write in pencil or ball pen, because the oil is not transferred to the fixing media so much. Moreover, the problems of a reduction in density of the full color images caused by fluctuations in chargeability under the circumstances of high temperature and humidity and low temperature and humidity, toner cloud and fog, which are the disadvantages of polyesters, are solved, and the fixed images having good image quality can be obtained. The present invention is therefore suitable for fixing full color toner images on transfer media such as OHP sheets.

What is claimed is:

1. A method for fixing a full color toner image by inserting a transfer medium to which a toner image is transferred, between a pair of rolls of a fixing apparatus, and pressing the medium therebetween, wherein said toner image is formed of a full color toner prepared by dispersing a colorant into a polyester resin containing a diol component represented by general formula (I) as a constituent and having a softening point of 100° to 120°

C., as measured by a ring and ball method, a glass transition temperature of 55° C. or more, a Gardner color scale of 2 or less and a haze value of 15 or less, and the fixing operation is conducted while supplying a silicone composition containing at least a functional group-containing organopolysiloxane having a viscosity of 10 to 100,000 cs at 25° C. represented by general formula (II) to a roll in contact with said toner image:

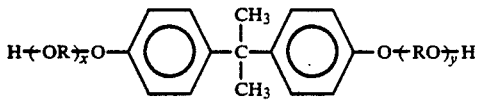

(I)

wherein R represents an ethylene group or a propylene group, each of x and y is an integer of 1 or more, and x+y is 2 to 6,

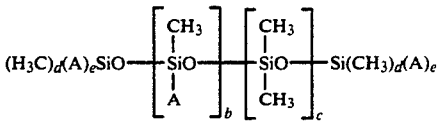

(II)

wherein A represents $—R^1NH_2$, $—R^1NHR^2NH_2$, $—R^1—O—Y_f—H$ or -H (wherein each of $R^1$ and $R^2$ represents an alkylene group having 1 to 8 carbon atoms and Y represents an alkyleneoxy group having 2 to 4 carbon atoms), b is 0 to 10, c is 10 to 1,000, d is 2 or 3, e is 0 or 1, f is 0 to 10, d+e is 3, and b and c are not 0 at the same time.

2. A method for fixing a full color toner image as claimed in claim 1, wherein said polyester resin having a softening point of 105° to 115° C. as measured by a ring and ball method.

* * * * *

UNITED STATES PATENT AND TRADEMARK OFFICE

CERTIFICATE OF CORRECTION

PATENT NO. : 5,250,996

DATED : October 05, 1993

INVENTOR(S) : Yutaka Sugizaki et al.

It is certified that error appears in the above-indentified patent and that said Letters Patent is hereby corrected as shown below:

Claim 1, column 16, line 9, change " —R- "

to ---$R^1$--.

Claim 1, column 16, line 10, delete "$^1$".

Signed and Sealed this

Thirtieth Day of August, 1994

*Attest:*

*Attesting Officer*

BRUCE LEHMAN

*Commissioner of Patents and Trademarks*